US007355372B2

(12) United States Patent
Huang et al.

(10) Patent No.: US 7,355,372 B2
(45) Date of Patent: Apr. 8, 2008

(54) POWER CONTROL SYSTEM CAPABLE OF BALANCING OUTPUT CURRENTS

(75) Inventors: Sheng-Chung Huang, Taipei (TW); Li-Chung Wang, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 0 days.

(21) Appl. No.: 11/657,609

(22) Filed: Jan. 25, 2007

(65) Prior Publication Data

US 2007/0170905 A1 Jul. 26, 2007

(30) Foreign Application Priority Data

Jan. 26, 2006 (TW) ..... 95103153 A

(51) Int. Cl.
*G05F 1/565* (2006.01)

(52) U.S. Cl. ..... 323/275; 323/285; 323/277

(58) Field of Classification Search ..... 323/272, 323/274, 275, 276, 277, 282, 284, 285
See application file for complete search history.

(56) References Cited

U.S. PATENT DOCUMENTS 5,834,925 A * 11/1998 Chesavage ..... 323/272
6,215,290 B1 * 4/2001 Yang et al. ..... 323/282
6,404,175 B1 * 6/2002 Yang et al. ..... 323/282
7,164,258 B2 * 1/2007 Umminger ..... 323/282

* cited by examiner

*Primary Examiner*—Jessica Han
(74) *Attorney, Agent, or Firm*—Birch, Stewart, Kolasch & Birch, LLP

(57) ABSTRACT

A power control system includes a voltage control circuit and a plurality of balance circuits. The voltage control circuit controls a voltage level at an output of the power control system according to a reference voltage. Each of the plurality of balancing circuits outputs a current, whose magnitude is a specific ratio to an output current outputted from the voltage control circuit. The power control system is capable of balancing output currents of the voltage control circuit and the plurality of balance circuits in order to share output load of the power control system.

5 Claims, 2 Drawing Sheets

POWER CONTROL SYSTEM CAPABLE OF BALANCING OUTPUT CURRENTS

BACKGROUND OF THE INVENTION

1. Field of the Invention

The present invention relates to a power control system, and more particularly, to a power control system capable of balancing output currents.

2. Description of the Prior Art

Among electronic products, magnitudes of input voltages required for circuits and blocks are not entirely the same. Therefore, a circuit system of an electronic product has to include a power circuit capable of modulating output voltage. In prior art, power circuits utilized for modulating output voltages are roughly classified into two types including switching circuits and linear power circuits, the linear power circuits are also denoted as linear voltage step-down circuits.

High transformation efficiency is a benefit of switching circuits, however, high design complexity and high costs are also drawbacks to switching circuits. The circuit design of a linear power circuit is simple, but has the drawback of low efficiency. The low efficiency of linear power circuits results from the fact that elements of linear power circuits consume redundant power in the form of heat. While the linear power circuits output higher power, the elements of linear power circuits may break down because of being overheated. Moreover, equipping the elements of linear power circuits with radiators not only increases costs, but also occupies additional space in the electronic products.

For overcoming the defect that the elements of linear power circuits become overheated, a solution is provided in the prior art. The solution includes parallel connecting or serially connecting multiple elements in linear power circuits for sharing output power respectively and lowering quantities of heat generated from each element. The multiple elements may be power resistors and power diodes. However, there may be slight differences between the multiple elements, causing it to be difficult to precisely control the power shared by each element.

SUMMARY OF THE INVENTION

The claimed invention provides a power control system capable of balancing output currents. The power control system comprises a first voltage control circuit and a second voltage control circuit.

The first voltage control circuit comprises a first current control switch, a first current sensing unit, and a first comparison circuit. The first current control switch is coupled to a predetermined voltage source for outputting a first loading current according to the predetermined voltage source. The first current sensing unit is coupled to an output of the power control system and to the first current control switch for sensing a magnitude of the first loading current. The first comparison circuit has a first input for receiving a reference voltage, and a second input coupled to the output of the power control system. The first comparison circuit is utilized for comparing the reference voltage and voltage outputted at the output of the power control system for controlling the magnitude of the first loading current.

The second voltage control circuit comprises a second current control switch, a second current sensing unit, and a second comparison circuit. The second current control switch is coupled to the predetermined voltage source for outputting a second loading current according to the predetermined voltage source. The second current sensing unit is coupled to the output of the power control system and to the second current control switch for sensing a magnitude of the second loading current. The second comparison circuit has a first input coupled to the first current sensing unit, and a second input coupled to the second current sensing unit. The second comparison circuit is utilized for controlling the magnitude of the second loading current according to the magnitudes of the first loading current and the second loading current.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
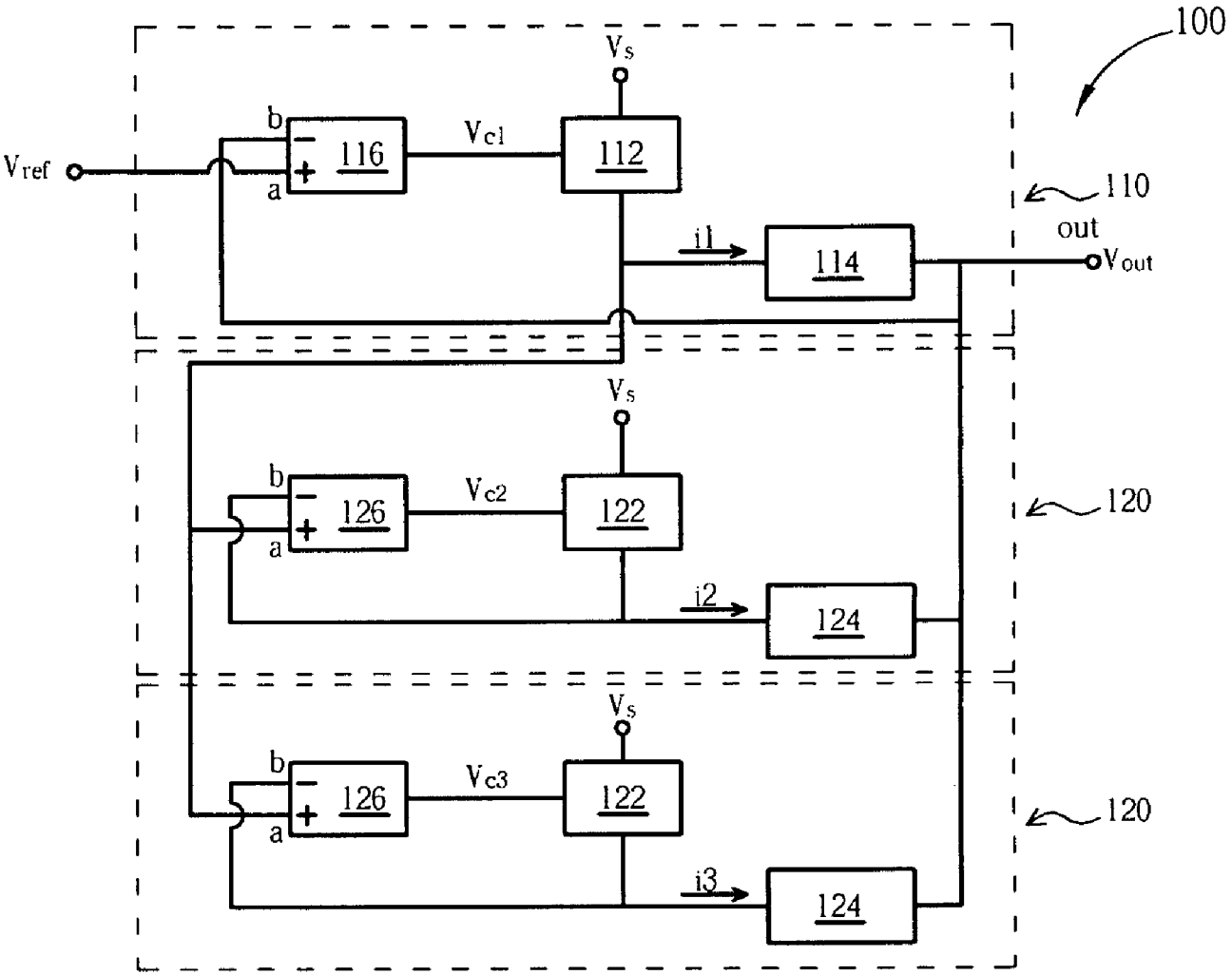
FIG. 1 is a block diagram of a power control system of the present invention.

Please refer to FIG. 1, which is a block diagram of a power control system 100 according to an embodiment of the present invention. The power control system 100 comprises a voltage control circuit 110 and a plurality of balancing circuits 120. The voltage control circuit 110 comprises a current control switch 112, a current sensing unit 114, and a comparison circuit 116. A first input "a" of the comparison circuit 116 is utilized for receiving a reference voltage $V_{ref}$, and a second input "b" of the comparison circuit 116 is coupled to an output "out" of the power control system 100.

The comparison circuit 116 is utilized for comparing the reference voltage $V_{ref}$ with voltage $V_{out}$ outputted at an output "out" of the power control system 100 and for outputting a control voltage $V_{c1}$ according to result of the comparison. The current control switch 112 is coupled to a predetermined voltage source $V_s$ for outputting a loading current $i_1$. The magnitude of the loading current $i_1$ outputted by the current control switch 112 depends on the control voltage $V_{c1}$ outputted by the comparison circuit 116. The current sensing unit 114 is coupled to the output "out" of the power control system 100 and to the current control switch 112 for sensing the magnitude of the loading current $i_1$ outputted by the current control switch 112.

Each balancing circuit 120 comprises a current control switch 122, a current sensing unit 124, and a comparison circuit 126. The current control switches 122 are coupled to the predetermined voltage source $V_s$ for respectively outputting loading currents $i_2$ and $i_3$. The magnitudes of the loading currents $i_2$ and $i_3$ outputted by the current control switches 122 depend on control voltages $V_{c2}$ and $V_{c3}$ outputted by the comparison circuits 126. The current sensing units 124 are coupled to the output "out" of the power control system 100 and to the current control switches 122 for sensing the magnitudes of the loading currents $i_2$ and $i_3$ outputted by the current control switches 122. The first inputs "a" of the comparison circuits 126 are coupled to the current sensing unit 114 of the voltage control circuit 110, and the second inputs "b" of the comparison circuits 126 are coupled to the current sensing units 124. Therefore, the comparison circuit 126 of each balancing circuit 120 is utilized for outputting a control voltage, which is respectively the control voltage $V_{c2}$ or $V_{c3}$ as shown in FIG. 1, according to the comparison result of comparing the loading current $i_1$ sensed by the current sensing unit 114 of the voltage control circuit 110 with the loading current, which is the loading current $i_2$ or $i_3$ as shown in FIG. 1, sensed by the current sensing unit 124 of the corresponding balancing circuit 120.

In other words, the voltage control circuit 110 is utilized for controlling the magnitude of the voltage $V_{out}$ outputted at the output "out" of the power control system 100 according to the reference voltage $V_{ref}$. Each balancing circuit 120 is utilized for outputting a predetermined current having a specific scale, for example currents having equivalent magnitudes, from the plurality of balancing circuits 120, according to the magnitude of the loading current $i_1$ outputted by the voltage control circuit 110. Therefore, the power control system 100 is capable of outputting substantially equal currents for balancing the power shared by the voltage control circuit 110 and the plurality of balancing circuits 120.

Figure 2:
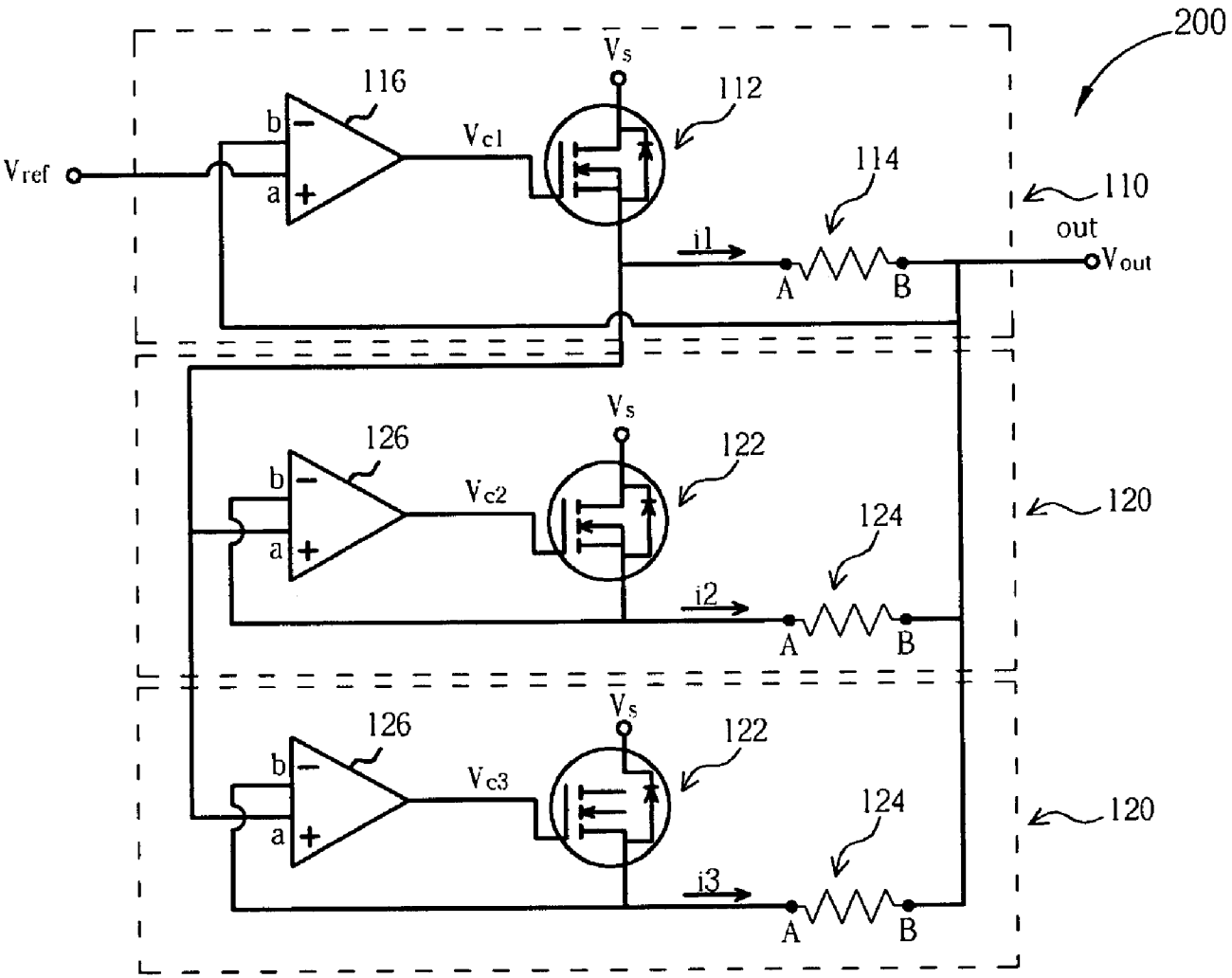
FIG. 2 is a diagram of a preferred embodiment of the power control system shown in FIG. 1.

Please refer to FIG. 2 in addition to FIG. 1. FIG. 2 is a diagram of a preferred embodiment of the power control system 100 shown in FIG. 1, i.e., a power control system 200. In FIG. 2, the power control system 200 comprises current control switches 112 and 122, current sensing units 114 and 124, and comparison circuits 116 and 126. The current control switches 112 and 122 may be metal-oxide semiconductor field effect transistors. The current sensing units 114 and 124 may be resistors. The comparison circuits 116 and 126 may be operational amplifiers. However, the elements of the power control system 200 mentioned above may be replaced with other elements or other circuits having the same functions.

For example, the current sensing units 114 and 124 may also be conductors having higher resistances. The comparison circuits 116 and 126 may also be integrated circuits of other types. The comparison circuit 116, which is an operational amplifier as shown in FIG. 2, is utilized for outputting the control voltage $V_{c1}$ after comparing the reference voltage $V_{ref}$ and the voltage $V_{out}$ outputted at the output "out" of the power control system 100. When the voltage $V_{out}$ does not equal the reference voltage $V_{ref}$, the control voltage $V_{c1}$ outputted by the operation amplifier implementing the comparison circuit 116 continuously modulates the loading current $i_1$ outputted by the metal-oxide semiconductor field effect transistor implementing the current control switch 112 until the voltage $V_{out}$ equals the reference voltage $V_{ref}$. Since the magnitude of the voltage $V_{out}$ and the resistances of the resistors implementing the current sensing units 114 and 124 are known, the magnitudes of the loading currents $i_1$, $i_2$, $i_3$ outputted by the metal-oxide semiconductor field effect transistors implementing the current control switches 112 and 122 can be generated by merely measuring the voltages at a first terminal "A" of the resistors implementing the current sensing units 114 and 124 as shown in FIG. 2.

The operation amplifiers implementing the comparison circuits 126 of balancing circuits 120 output the control voltages $V_{c2}$ and $V_{c3}$ after the magnitude of the voltage at the first terminal "A" of the resistor implementing the current sensing unit 114 is compared with the magnitude of the voltage at the first terminal "A" of the resistor implementing the current sensing unit 124, i.e., after comparing the magnitudes of the loading currents $i_1$, $i_2$, and $i_3$ as shown in FIG. 2. When the voltage at the first terminal "A" of the resistor implementing the current sensing unit 124 does not equal the voltage at the first terminal "A" of the resistor implementing the current sensing unit 114, the control voltages $V_{c2}$ and $V_{c3}$ continuously modulate the magnitudes of the loading currents $i_2$ and $i_3$ outputted by the metal-oxide semiconductor field effect transistors implementing the current control switches 122 until the voltage at the first terminal "A" of the resistor implementing the current sensing unit 1324 equals the voltage at the first terminal "A" of the resistor implementing the current sensing unit 114.

In other words, when the resistance of the resistor implementing the current sensing unit 114 of the voltage control circuit 110 equals the resistance of the resistors implementing the current sensing units 124 of the balancing circuits 120, the operational amplifiers implementing the comparison circuits 126 of the balancing circuits 120 control the metal-oxide semiconductor field effect transistors implementing the current control switches 122 so that the loading currents $i_2$ and $i_3$ outputted by the balancing circuits 120 are equal to the loading current $i_1$ outputted by the voltage control circuit 110. However, the resistances of the resistors implementing the current sensing units 114 and 124 may also be modified so that the loading currents $i_2$ and $i_3$ are equal to a predetermined percentage of the loading current $i_1$ outputted by the voltage control circuit 110.

In summary, the embodiment of the present invention provides a power control system 100 for precisely controlling the power shared by the voltage control circuit 110 and the balancing circuits 120. Therefore, the power control system 100 can output with a higher power while outputting a predetermined output voltage. Additionally, although two power balancing circuits 120 are shown in FIG. 1 and FIG. 2, the embodiment of the present invention may be practiced using any number of power balancing circuits 120 without departing from the spirit of the invention.

Compared with the prior arts, the power control system 100 of the embodiment of present invention has simpler circuits and lower costs. Moreover, the power control system of the present invention can precisely control the magnitudes of the loading circuits outputted by the voltage control circuit and the balancing circuits for balancing the power shared by the voltage control circuit and the balancing circuits, and for solving the prior art defect that the elements are overheated because of a higher power.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power control system capable of balancing output currents, the power control system comprising:

a first voltage control circuit comprising:

a first current control switch coupled to a predetermined voltage source for outputting a first loading current according to the predetermined voltage source;

a first current sensing unit coupled to an output of the power control system and to the first current control switch for sensing a magnitude of the first loading current; and a first comparison circuit having a first input for receiving a reference voltage, and a second input coupled to the output of the power control system, the first comparison circuit being utilized for comparing the reference voltage and voltage outputted at the output of the power control system for controlling the magnitude of the first loading current; and a second voltage control circuit comprising:

a second current control switch coupled to the predetermined voltage source for outputting a second loading current according to the predetermined voltage source;

a second current sensing unit coupled to the output of the power control system and to the second current control switch for sensing a magnitude of the second loading current; and a second comparison circuit having a first input coupled to the first current sensing unit, and a second input coupled to the second current sensing unit, the second comparison circuit being utilized for controlling the magnitude of the second loading current according to the magnitudes of the first loading current and the second loading current.

2. The power control system of claim 1 wherein the first current control switch and the second current control switch are metal-oxide semiconductor field effect transistors.

3. The power control system of claim 1 wherein the first current sensing unit and the second current sensing unit are resistors.

4. The power control system of claim 3 wherein resistance of the first current sensing unit equals resistance of the second current sensing unit.

5. The power control system of claim 1 wherein the first comparison circuit and the second comparison circuit are operation amplifiers.

* * * * *